US010526773B2

(12) United States Patent
Mu et al.

(10) Patent No.: US 10,526,773 B2
(45) Date of Patent: Jan. 7, 2020

(54) RETRACTABLE FAUCET WITH GUIDED MECHANICAL RESET

(71) Applicant: XIAMEN SOLEX HIGH-TECH INDUSTRIES CO., LTD., Xiamen, Fujian (CN)

(72) Inventors: Weihai Mu, Fujian (CN); Chunjie Hong, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 15/392,955

(22) Filed: Dec. 28, 2016

(65) Prior Publication Data

US 2017/0292252 A1 Oct. 12, 2017

(30) Foreign Application Priority Data

Apr. 8, 2016 (CN) ..... 2016 1 0217252

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC . E03C 1/0404; E03C 2001/0415; F16L 37/48
USPC ..... 285/361, 358, 376, 360, 401
See application file for complete search history.

(56) References Cited

U.S. PATENT DOCUMENTS 4,733,438 A * 3/1988 Stupakis ..... F16L 33/22 24/19
5,387,182 A * 2/1995 Otani ..... A61C 17/0214 601/165
6,250,688 B1 * 6/2001 Kirby ..... F16L 49/06 285/148.21
7,909,061 B2 * 3/2011 Nelson ..... E03C 1/0404 137/801
8,302,620 B2 * 11/2012 Lin ..... E03C 1/04 137/315.12
2004/0010848 A1 * 1/2004 Esche ..... E03C 1/04 4/675
2011/0101682 A1 * 5/2011 Vatne ..... E21B 17/01 285/308

(Continued)

*Primary Examiner* — Alexander M Valvis
*Assistant Examiner* — Qingzhang Zhou
(74) *Attorney, Agent, or Firm* — Cooper Legal Group, LLC

(57) ABSTRACT

A retractable faucet with guided mechanical reset includes a retractable flexible pipe; an outlet portion having an end face and being connected to the retractable flexible pipe; a weight; and a support through which the retractable flexible pipe passes and connects to the weight and that has a front-end face that contacts the end face of the outlet portion. The support has a guiding groove and the outlet portion is provided with a guiding structure that is surrounded by and coupled to the guiding groove. The guiding groove has guiding surfaces continuously arranged from a lowest position to a highest position, and the guiding structure and the guiding groove move relative to one another due to gravity of the weight to cause the guiding structure to move to the highest position to bringing the end face of the outlet portion in contact with the front-end face of the support.

15 Claims, 9 Drawing Sheets

(56) References Cited

U.S. PATENT DOCUMENTS

2014/0263756 A1* 9/2014 Meehan ..... B05B 1/1627
239/446
2016/0237663 A1* 8/2016 Myers ..... E03C 1/0404

* cited by examiner

RETRACTABLE FAUCET WITH GUIDED MECHANICAL RESET

FIELD OF THE INVENTION

The present invention relates to an outlet device, particularly to a retractable outlet device.

BACKGROUND OF THE INVENTION

Traditional kitchen taps have the outlet end drawn back under the gravity of the weight block when the tap is not used so as to realize reset. As the outlet end and the end face of the support pipe are only contacted in the axial direction for location when the outlet end is being reset, no location function is applied in the radial direction. Therefore, the outlet end would be in any direction in the radial direction after reset. For the user, this kind of the reset method is unfriendly, the user needs to re-build the habit and adjust the direction of the outlet end every time, making the outlet button of the outlet end in a proper position.

SUMMARY OF THE INVENTION

The present invention is provided with a retractable outlet device that the outlet mechanism automatically resets in the axial and radial direction after the outlet mechanism is pulled to use from the support mechanism.

The present invention is further provided with a retractable outlet device that the outlet button is always faced to the user or opposite to the user after the outlet mechanism is reset.

The present invention is further provided with a retractable outlet device that the end face contact of the reset outlet mechanism and the support mechanism is strong, making the contact of the end face of the outlet mechanism and the front end face of the support mechanism with smaller gap.

The technical solution of the present invention is that:

A retractable outlet device with mechanical guiding reset function, wherein comprising a support mechanism and an outlet mechanism; the outlet mechanism comprises an outlet portion, the end of the outlet portion is connected to a retractable flexible pipe; the retractable flexible pipe passes through the support mechanism to connect to a weight element, the end face of the outlet mechanism is contacted with the front end face of the support mechanism by the weight of the weight element; the outlet mechanism and the support mechanism are disposed with a guiding device and a guiding groove in coupling way; the guiding groove is disposed with continuously arranged guiding surfaces from the lowest position to the highest position; the guiding device and the guiding groove move relatively under the gravity of the weight element, making the guiding device move to the highest position of the guiding groove along the guiding surfaces, making the end face of the outlet mechanism contacted with the front end face of the support mechanism.

In another preferred embodiment, the support mechanism comprises a support pipe and an insert base; the insert base is embedded to the front end of the support pipe, the insert base is disposed with an accommodating chamber with two ends opening along the length direction of the support pipe, the inner wall of the accommodating chamber is disposed with the guiding groove.

In another preferred embodiment, the two ends of the guiding groove are the lowest position, the highest position is at the center of the guiding groove; the guiding surface is an arc surface.

In another preferred embodiment, comprising two guiding grooves with two ends of them respectively connected and symmetrically arranged in the axial direction of the accommodating chamber.

In another preferred embodiment, the end of the outlet mechanism is an embedding end, when the end face of the outlet mechanism is contacted with the front end face of the support mechanism, the embedding end is embedded to the accommodating chamber; the guiding device comprises two roll balls, two ribs or two bearings disposed at the side wall of the embedding end and symmetrically arranged in the axial direction of the embedding end.

In another preferred embodiment, the side wall of the outlet mechanism is disposed with an outlet button, the intersection angle of the outlet button and the roll ball, the rib or the bearing is 90°.

In another preferred embodiment, the front end of the insert base extends out with a platform in the direction vertical to the side wall of the insert base; when the insert base is embedded to the front end of the support pipe, the platform covers the front end of the support pipe.

In another preferred embodiment, the end of the insert base is disposed with a magnetic device to generate magnetic force to the outlet mechanism.

A retractable outlet device with mechanical guiding reset function, wherein comprising a support mechanism and an outlet mechanism; the outlet mechanism comprises an outlet portion, the end of the outlet portion is connected to a retractable flexible pipe; the retractable flexible pipe passes through the support mechanism to connect to a weight element, the end face of the outlet mechanism is contacted with the front end face of the support mechanism by the weight of the weight element; the outlet mechanism and the support mechanism are disposed with a guiding groove and a guiding device in coupling way; the guiding groove is disposed with continuously arranged guiding surfaces from the lowest position to the highest position; the guiding device and the guiding groove move relatively under the gravity of the weight element, making the guiding device move to the lowest position of the guiding groove along the guiding surfaces, making the end face of the outlet mechanism contacted with the front end face of the support mechanism.

In another preferred embodiment, the support mechanism comprises a support pipe and an insert base; the insert base is embedded to the front end of the support pipe, the insert base is disposed with an accommodating chamber with two ends opening along the length direction of the support pipe, the inner wall of the accommodating chamber is disposed with the guiding device.

In another preferred embodiment, the end of the outlet mechanism is an embedding end, when the end face of the outlet mechanism is contacted with the front end face of the support mechanism, the embedding end is embedded to the accommodating chamber In another preferred embodiment, the guiding groove is disposed at the external periphery of the side wall of the embedding end, the two ends of the guiding groove are the highest position, the lowest position is at the center of the guiding groove; the guiding surface is an arc surface.

In another preferred embodiment, comprising two guiding grooves with two ends of them respectively connected and symmetrically arranged in the axial direction of the accommodating chamber.

In another preferred embodiment, the guiding device comprises two roll balls, two ribs or two bearings disposed at the side wall of the embedding end and symmetrically arranged in the axial direction of the accommodating chamber.

In another preferred embodiment, the side wall of the outlet mechanism is disposed with an outlet button, the intersection angle of the outlet button and the roll ball, the rib or the bearing is 0°.

In another preferred embodiment, the front end of the insert base extends out with a platform in the direction vertical to the side wall of the insert base; when the insert base is embedded to the front end of the support pipe, the platform covers the front end of the support pipe.

In another preferred embodiment, the end of the insert base is disposed with a magnetic device to generate magnetic force to the outlet mechanism.

Compared to the traditional technology, the technical solution of the present invention has following advantages;

1. The present invention is provided with a retractable outlet device with mechanical guiding reset function that the outlet mechanism moves towards the front end of the support mechanism due to the gravity of the weight element; as the end face of the outlet mechanism is contacted with the front end face of the support mechanism, the outlet mechanism is reset the outlet mechanism and the support mechanism are disposed with a guiding device and a guiding groove in coupling way; the guiding groove is disposed with continuously arranged guiding surfaces from the lowest position to the highest position; in this embodiment, two ends of the guiding groove are the lowest position, the highest position is at the center of the guiding groove; the guiding surface is an arc surface. When the outlet mechanism moves towards the support mechanism, the guiding device and the guiding grove move relatively under the gravity of the weight element, making the guiding device move to the highest position of the guiding groove along the guiding surface, making the end face of the outlet mechanism contacted with the front end face of the support mechanism. Therefore, when the end face of the outlet mechanism is contacted with the front end face of the support mechanism, the guiding device is always at the highest position of the guiding groove, making the outlet mechanism reset both in the axial direction and the radial direction.

2. The present invention is provided with a retractable outlet device with mechanical guiding reset function that there are two guiding grooves symmetrically arranged, when the guiding device coupled to one guiding surface of the guiding groove, the outlet button is faced to the user when the outlet device is reset; when the guiding device is coupled to another guiding surface of the guiding groove, the outlet button is opposite to the user after the outlet device is reset. Therefore, whatever direction the outlet device resets with respect to the support mechanism, the outlet device is situated in either above mentioned positions with respect to the support mechanism after reset. The positions of the outlet button facing inward and outward are both very convenient for the user, ensuring that the user needn't to pull and then rotate the outlet mechanism to the proper position before he or she wants to use the device, thus improving the handheld feeling and smoothness.

3. The present invention is provided with a retractable outlet device with mechanical guiding reset function that the support mechanism comprises a support pipe and an insert base, the front end of the insert base extends out with a platform in the direction vertical to the side wall of the insert base; when the insert base is embedded to the front end of the support pipe, the platform covers the front end of the support pipe. Therefore, when the outlet mechanism is reset, the end face of the outlet mechanism impacts and contacts with the platform. As the platform can be made of soft material, plastic for example, it avoids loud noise and damage due to the end face of the outlet mechanism directly impacting the support pipe.

4. The present invention is provided with a retractable outlet device with mechanical guiding reset function that the end of the insert base is disposed with a magnetic ring to generate magnetic force to the outlet mechanism, making the contact of the end face of the outlet mechanism and the platform tighter and the gap therebetween smaller.

DETAILED DESCRIPTION OF THE EMBODIMENTS

The present invention will be further described with the drawings and the embodiments.

Figure 1:
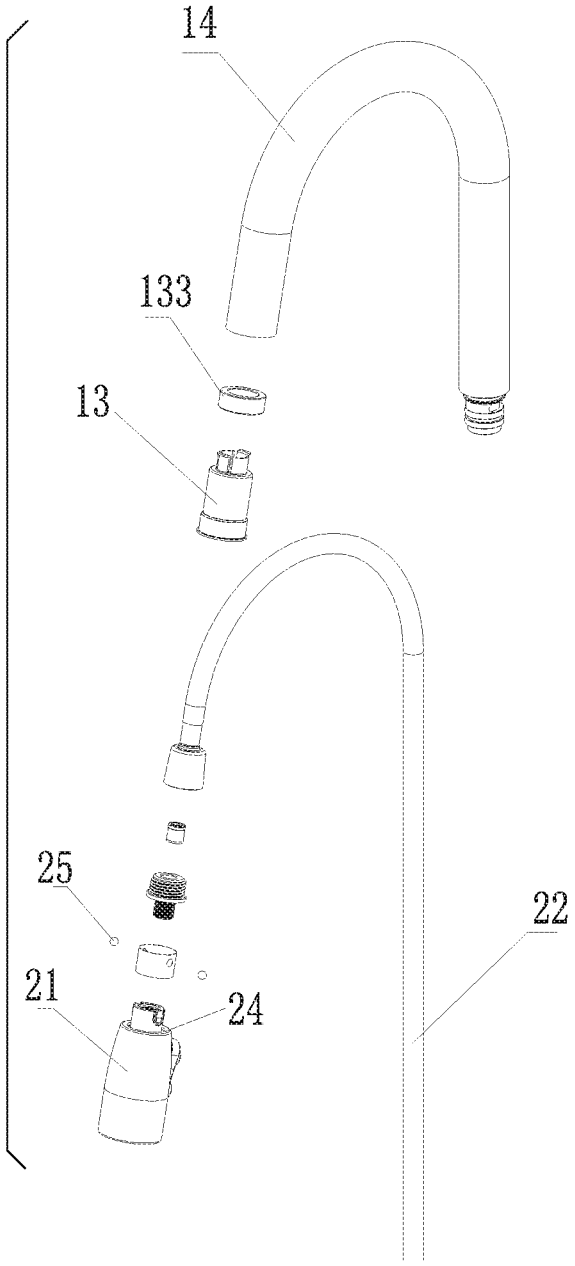
FIG. 1 illustrates an exploded and schematic diagram of a retractable outlet device of Embodiment 1 of the present invention.
Figure 2:
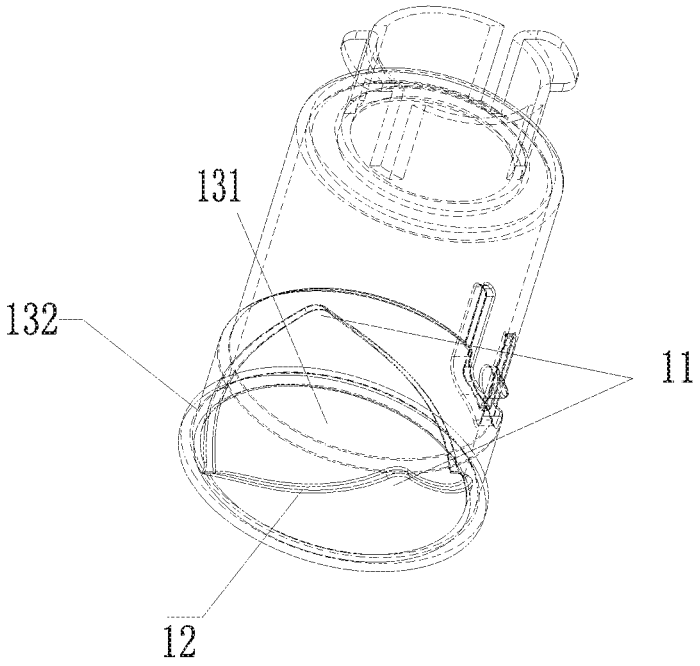
FIG. 2 illustrates a schematic diagram of an insert base of Embodiment 1 of the present invention.
Figure 3:
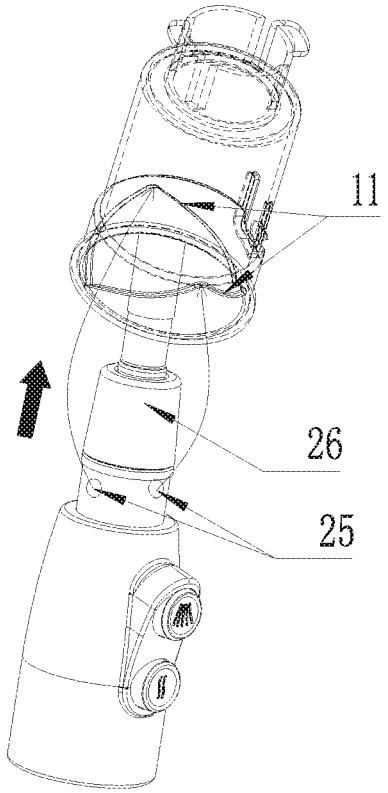
FIG. 3 illustrates a schematic diagram of a guiding device and a guiding groove of Embodiment 1 of the present invention.
Figure 4:
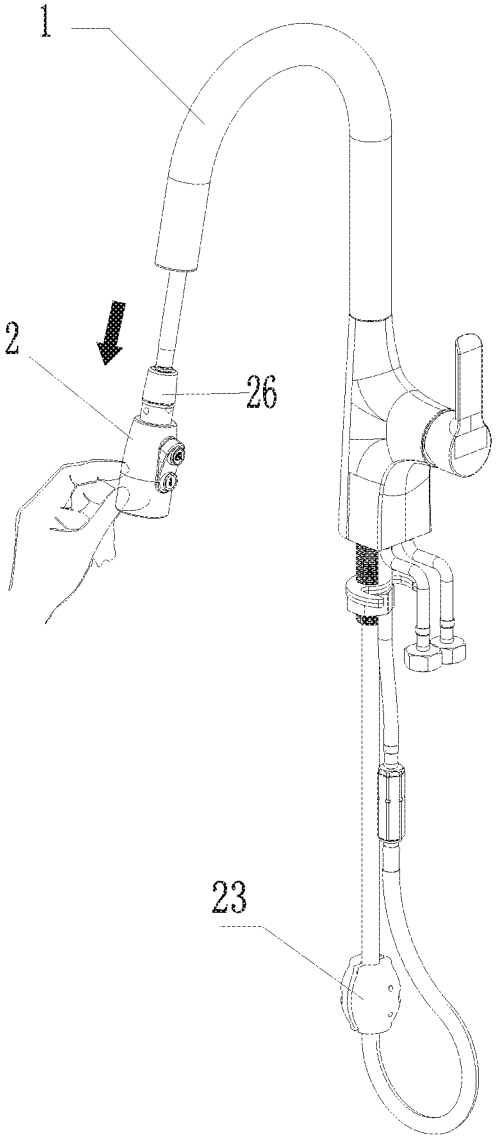
FIG. 4 illustrates a schematic diagram of an outlet mechanism being pulled out of Embodiment 1 of the present invention.
Figure 5:
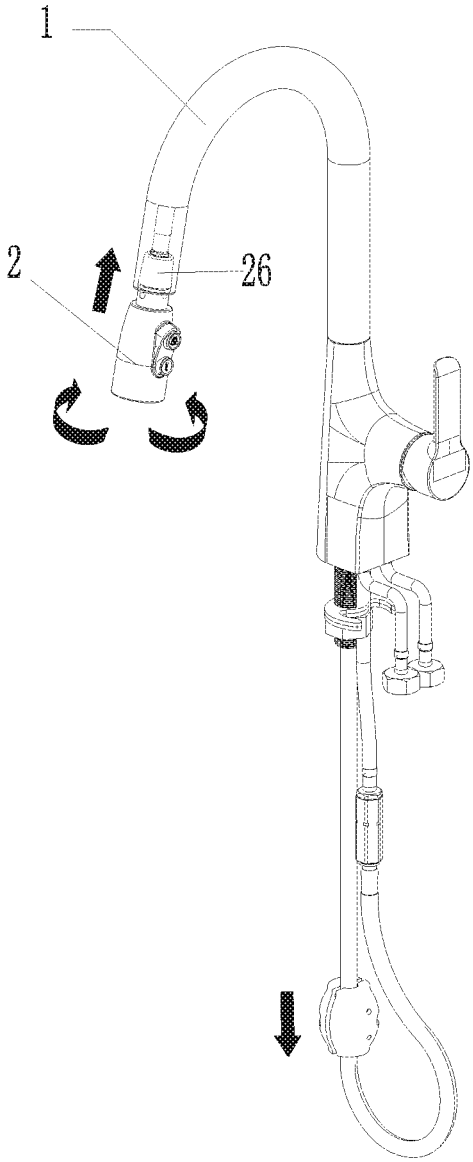
FIG. 5 illustrates a schematic diagram of the outlet mechanism being reset of Embodiment 1 of the present invention.
Figure 6:
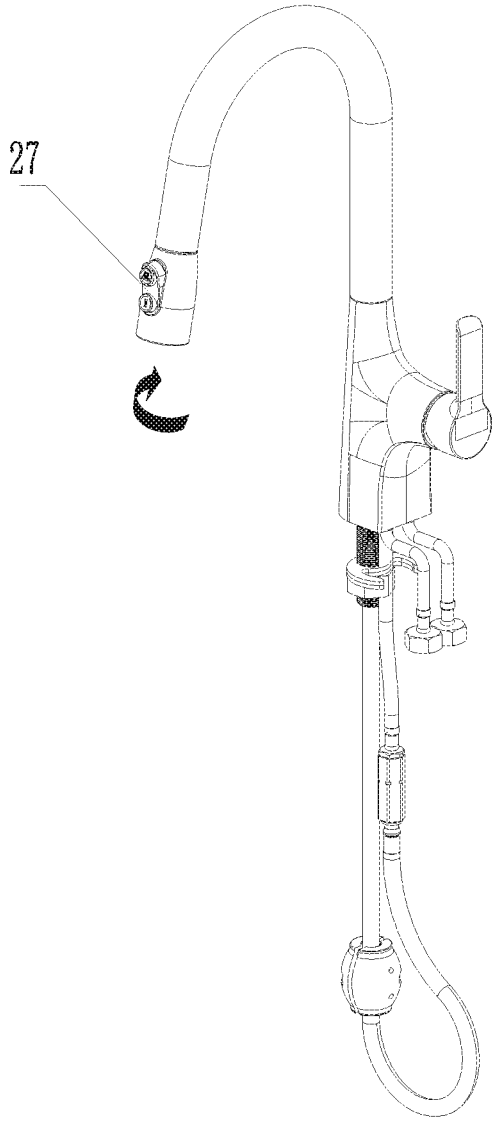
FIG. 6 illustrates a schematic diagram of the outlet mechanism in one position of Embodiment 1 of the present invention.
Figure 7:
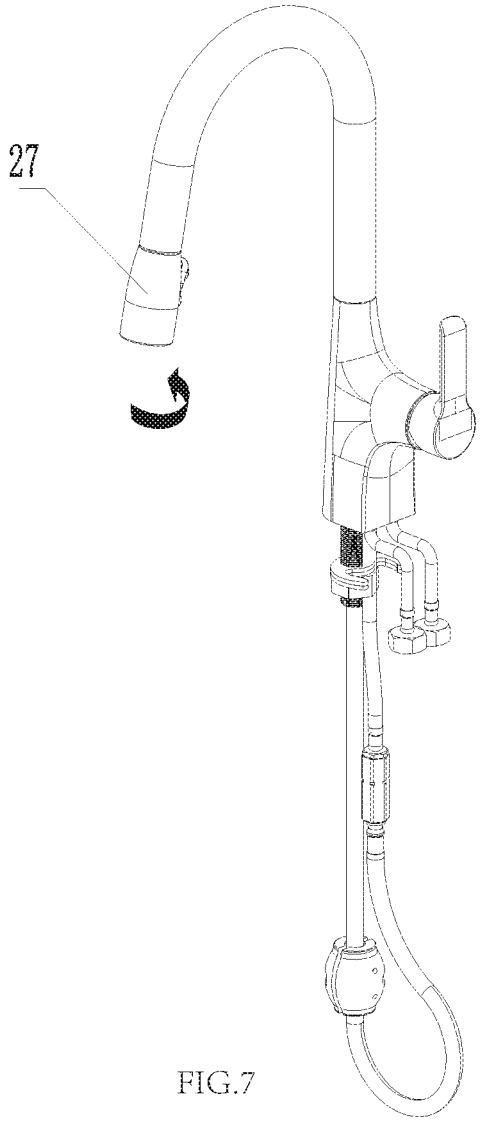
FIG. 7 illustrates a schematic diagram of the outlet mechanism in another position of Embodiment 1 of the present invention.
Figure 8:
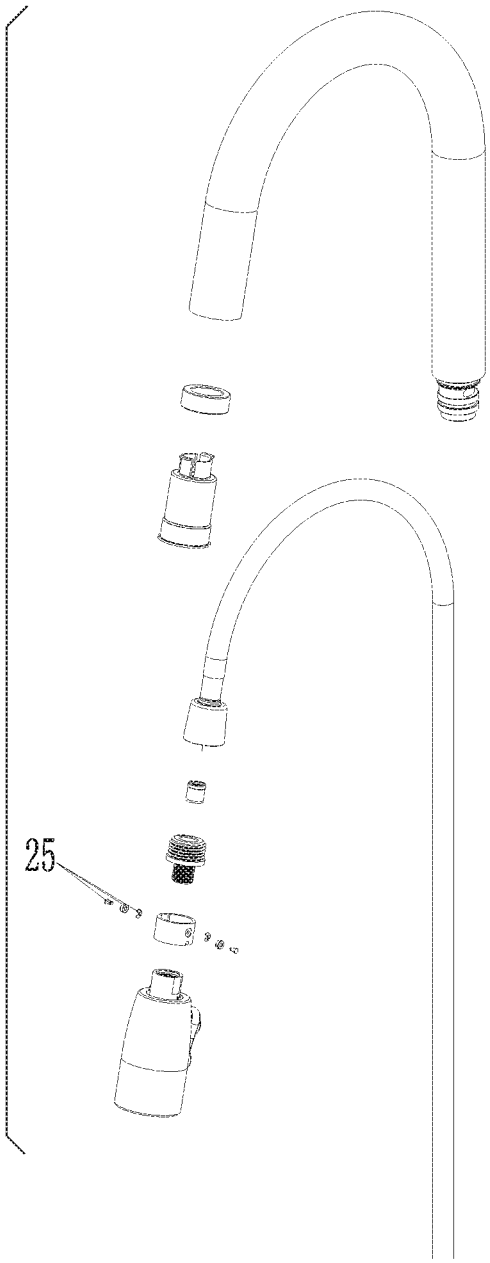
FIG. 8 illustrates an exploded and schematic diagram of a retractable outlet device of Embodiment 2 of the present invention.
Figure 9:
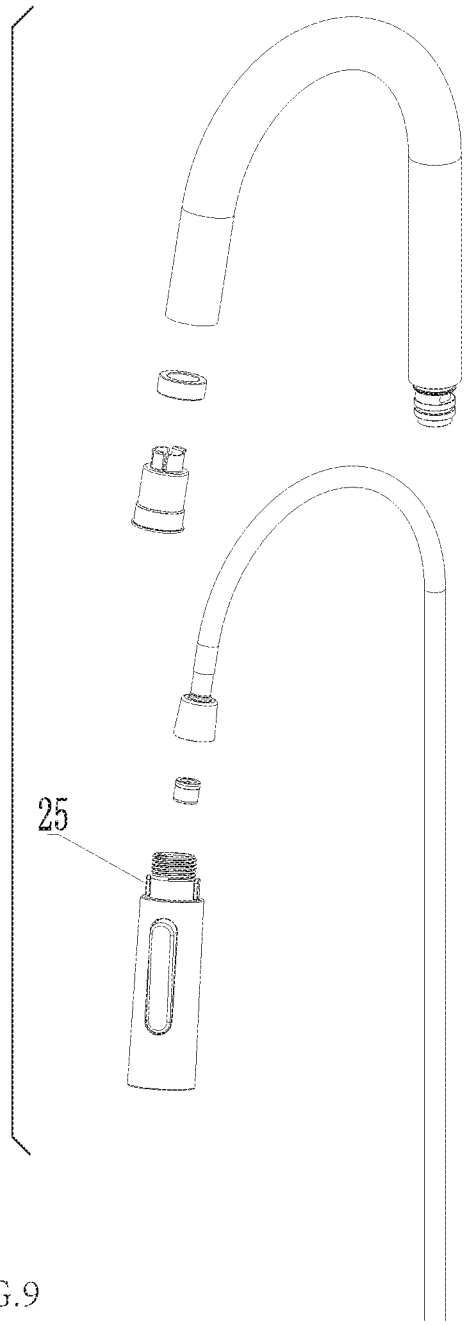
FIG. 9 illustrates an exploded and schematic diagram of a retractable outlet device of Embodiment 3 of the present invention.

Embodiment 1:

Referring to FIGS.1-7, a retractable outlet device with mechanical guiding reset function comprises a support mechanism 1 and an outlet mechanism 2; the outlet mechanism 2 comprises an outlet portion 21, the end of the outlet portion 21 is connected to a retractable flexible pipe 22; the retractable flexible pipe 22 passes through the support mechanism to connect to a weight element 23, the end face 24 of the outlet mechanism 2 is contacted with the front end face of the support mechanism 1 by the weight of the weight element 23; therefore, when the outlet mechanism is pulled away from the front end face of the support mechanism 1, when the pull force is released, the outlet mechanism 2 moves towards the front end of the support mechanism 1 due to the gravity of the weight element 23; as the end face 24 of the outlet mechanism 2 is contacted with the front end face of the support mechanism 1, the outlet mechanism 2 is reset.

The reset of the outlet mechanism 2 is finished only in the axial direction, the outlet mechanism 2 can be in any position in the radial direction. To make the outlet mechanism resettable in the radial direction, the outlet mechanism 2 and the support mechanism 1 are disposed with a guiding device 25 and a guiding groove 11 in coupling way; the guiding groove 11 is disposed with continuously arranged guiding surfaces 12 from the lowest position to the highest position; in this embodiment, two ends of the guiding groove are the lowest position, the highest position is at the center of the guiding groove 11; the guiding surface 12 is an arc surface. When the outlet mechanism 2 moves towards the support mechanism 1, the guiding device 25 and the guiding grove 11 move relatively under the gravity of the weight element, making the guiding device 25 move to the highest position of the guiding groove 11 along the guiding surface 12, making the end face 24 of the outlet mechanism 2 contacted with the front end face of the support mechanism 1. Therefore, when the end face 24 of the outlet mechanism 2 is contacted with the front end face of the support mechanism 1, the guiding device 25 is always at the highest position of the guiding groove 1, making the outlet mechanism reset both in the axial direction and the radial direction.

Preferred, this embodiment is configured that: the support mechanism 1 comprises a support pipe 14 and an insert base 13; the insert base 13 is embedded to the front end of the support pipe 14, the insert base 13 is disposed with an accommodating chamber 131 with two ends opening along the length direction of the support pipe 14, the inner wall of the accommodating chamber 131 is disposed with the guiding groove 11. There are two guiding grooves 11 with two ends of them respectively connected and symmetrically arranged in the axial direction of the accommodating chamber 131.

The end of the outlet mechanism 2 is an embedding end 26, when the end face 24 of the outlet mechanism 2 is contacted with the front end face of the support mechanism 1, the embedded end 26 is embedded to the accommodating chamber 131; the guiding device 25 comprises two roll balls disposed at the side wall of the embedding end 26, the intersection angle of the roll balls is 180°.

The side wall of the outlet mechanism 2 is disposed with an outlet button 27, the intersection angle of the outlet button 27 and the roll ball is 90°. When the roll balls are coupled to one guiding surface 12 of the guiding groove 11, the outlet button 27 is faced to the user when the outlet device 2 is reset; when the roll balls are coupled to another guiding surface 12 of the guiding groove 11, the outlet button 27 is opposite to the user after the outlet device 2 is reset. Therefore, whatever direction the outlet device 2 resets with respect to the support mechanism 1, the outlet device 2 is situated in either above mentioned positions with respect to the support mechanism 1 after reset. The positions of the outlet button 27 facing inward and outward are both very convenient for the user, ensuring that the user needn't to pull and then rotate the outlet mechanism 2 to the proper position before he or she wants to use the device, thus improving the handheld feeling and smoothness.

In this embodiment, the front end of the insert base 13 extends out with a platform 132 in the direction vertical to the side wall of the insert base 13; when the insert base 13 is embedded to the front end of the support pipe 14, the platform 132 covers the front end of the support pipe 14. Therefore, when the outlet mechanism 2 is reset, the end face 24 of the outlet mechanism 2 impacts and contacts with the platform 132. As the platform 132 can be made of soft material, plastic for example, it avoids loud noise and damage due to the end face 24 of the outlet mechanism 2 directly impacting the support pipe 14.

The end of the insert base 13 is disposed with a magnetic device 133 to generate magnetic force to the outlet mechanism 2, making the contact of the end face 24 of the outlet mechanism 2 and the platform 132 tighter and the gap therebetween smaller.

Embodiment 2:

This embodiment differs from Embodiment 1 in that the guiding device 25 is bearing structure but not roll ball, the rest portion is similar to Embodiment 1 that it would not be further described.

Embodiment 3:

This embodiment differs from Embodiment 1 in that the guiding device 25 is rib but not roll ball, the rest portion is similar to Embodiment 1 that it would not be further described.

Embodiment 4:

This embodiment differs from Embodiment 1 in that: the guiding device is disposed in the support mechanism, and the guiding groove is disposed in the outlet mechanism, the technical effect can be also achieved. In this configuration, the intersection angle of the outlet button and the roll balls, the ribs or the bearing is 0°.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A retractable faucet with a guided mechanical reset, comprising:

a support structure having a front-end face;

a retractable flexible pipe at least a portion of which retractably passes through the support structure via the front-end face of the support structure, wherein the retractable flexible pipe has one end on which is disposed a water outlet structure that has an internal end face and another end that extends beyond the support structure and is connected to a water source; and a weight that is connected to the retractable flexible pipe downline of the support structure and that pulls the retractable flexible pipe to retract from an extended position outside of the support structure to a retracted position in which the front-end face of the support structure contacts the internal end face of the water outlet structure, wherein:

at least two guiding structures are disposed radially symmetrically on the water outlet structure, the support structure has defined therein at least two continuous guiding grooves that respectively has at least one lowest position and a highest position, that accommodate and surround the guiding structures when the retractable flexible pipe is in the retracted position and that have guiding surfaces that are continuously arranged from the lowest position to the highest position of the continuous guiding grooves, the continuous guiding grooves are defined radially symmetrically on the support structure. and due to the weight, the water outlet structure moves axially and rotationally around its axis from the extended position to the retracted position along the guiding surfaces of the continuous guiding grooves defined in the support structure so that, when the retractable flexible pipe is in the retracted position, the guiding structures are respectively seated at the highest positions of the continuous guiding grooves and the internal end face of the water outlet structure is brought into registered contact with the front-end face of the support structure.

2. The retractable faucet according to claim 1, wherein:

the support structure comprises an insert base and a support pipe, the insert base is embedded in a front-end of the support pipe, and the insert base has defined therein an accommodating chamber having an inner wall in which is defined the continuous guiding grooves and having two ends that respectively open along a length direction of the support structure.

3. The retractable faucet according to claim 2, wherein:

each of the continuous guiding grooves has two lowest positions that triangulate with a center of the continuous guiding groove which defines the highest position, and the guiding surfaces are arc-shaped.

4. The retractable faucet according to claim 3, wherein two of the continuous guiding grooves are defined in the inner wall of the accommodating chamber of the insert base and are symmetrically arranged in an axial direction of the accommodating chamber of the insert base.

5. The retractable faucet according to claim 4, wherein:

the water outlet structure has an end that is an embedding end so that, when the internal end face of the water outlet structure contacts the front-end face of the support structure, the embedding end is embedded within the accommodating chamber of the insert base, each of the guiding structures extends from the embedding end and comprises a roller ball that is disposed on a side wall of the embedding end, and the roller balls are symmetrically arranged in an axial direction of the embedding end.

6. The retractable faucet according to claim 5, wherein:

the water outlet structure comprises an outlet button, and the outlet button forms an intersection angle with one roller ball of the roller balls that is 90°.

7. The retractable faucet according to claim 6, wherein the insert base of the support structure has a side wall and a front end that extends outwardly as a platform in a direction perpendicular to the side wall of the insert base so that, when the insert base is attached to the front-end face of the support structure, the platform covers the front-end face of the support structure.

8. The retractable faucet according to claim 2, wherein one end of the two ends of the insert base is disposed with a magnet to generate magnetic force to attract the water outlet structure toward the insert base.

9. The retractable faucet according to claim 1, wherein each of the guiding surfaces is arc-shaped.

10. The retractable faucet according to claim 1, wherein each of the guiding surfaces is spiral-shaped.

11. The retractable faucet according to claim 1, wherein when the internal end face of the water outlet structure is brought into registered contact with the front-end face of the support structure, a distance between the highest position and the front-end face of the support structure is longer than an distance between the highest position and the internal end face of the water outlet structure.

12. The retractable faucet according to claim 1, wherein the continuous guiding grooves have side guiding surfaces that are continuously connected to form a closed loop or a nearly closed loop in a head-to-tail manner.

13. The retractable faucet according to claim 1, wherein:

the support structure comprises an insert base, the insert base has defined therein an accommodating chamber having an inner wall in which is defined the continuous guiding grooves, the water outlet structure has an end that is an embedding end so that, when the internal end face of the water outlet structure contacts the front-end face of the support structure, the embedding end is embedded within the accommodating chamber of the insert base, each of the guiding structures extends from the embedding end and comprises a roller ball that is disposed on a side wall of the embedding end, and the roller balls are symmetrically arranged in an axial direction of the embedding end.

14. The retractable faucet according to claim 1, wherein a quantity of the continuous guiding grooves is equal to a quantity of the guiding structures.

15. A retractable faucet with a guided mechanical reset, comprising:

a support structure having a front-end face;

a retractable flexible pipe at least a portion of which retractably passes through the support structure via the front-end face of the support structure, wherein the retractable flexible pipe has one end on which is disposed a water outlet structure that has an internal end face and another end that extends beyond the support structure and is connected to a water source;

a guiding structure disposed on the water outlet structure; and a weight that is connected to the retractable flexible pipe downline of the support structure and that pulls the retractable flexible pipe to retract from an extended position outside of the support structure to a retracted position in which the front-end face of the support structure contacts the internal end face of the water outlet structure, wherein:

the support structure has defined therein a continuous guiding groove that has a lowest position and a highest position, that accommodates and surrounds the guiding structures when the retractable flexible pipe is in the retracted position and that has guiding surfaces that are continuously arranged from the lowest position to the highest position of the continuous guiding groove, due to the weight, the water outlet structure moves axially and rotationally around its axis from the extended position to the retracted position along the guiding surfaces of the continuous guiding groove defined in the support structure so that, when the retractable flexible pipe is in the retracted position, the guiding structure is seated at the highest position of the continuous guiding groove and the internal end face of the water outlet structure is brought into registered contact with the front-end face of the support structure, the support structure comprises an insert base, the insert base has defined therein an accommodating chamber having an inner wall in which is defined the continuous guiding grooves, the water outlet structure has an end that is an embedding end so that, when the internal end face of the water outlet structure contacts the front-end face of the support structure, the embedding end is embedded within the accommodating chamber of the insert base, and the guiding structure extends from the embedding end and comprises two roller balls that are disposed on a side wall of the embedding end and that are symmetrically arranged in an axial direction of the embedding end.

* * * * *